United States Patent [19]

Peabody et al.

[11] 4,346,494

[45] Aug. 31, 1982

[54] BRUSH STRUCTURE

[75] Inventors: Ralph C. Peabody; Bertil J. Sundberg, both of Minneapolis, Minn.

[73] Assignee: Tennant Company, Minneapolis, Minn.

[21] Appl. No.: 234,672

[22] Filed: Feb. 17, 1981

[51] Int. Cl.[3] ..... A46B 3/16; A46B 9/08

[52] U.S. Cl. ..... 15/179; 15/199; 29/132; 242/118.32

[58] Field of Search ..... 15/143 R, 186, 190, 15/191 R, 193, 194, 195, 199, 179–183, 230.11, 225, 226; 51/358, 405, 207; 29/120, 127, 128, 129.5, 132; 242/118.32, 118.31

[56] References Cited

U.S. PATENT DOCUMENTS

| | | | |
|---|---|---|---|
| 371,722 | 10/1919 | Wright . | |
| 2,286,245 | 6/1942 | Wilson et al. . | |
| 2,651,803 | 9/1953 | Brown . | |
| 2,708,280 | 5/1955 | Antos et al. . | |
| 2,739,340 | 3/1956 | Blyndenburgh et al. . | |
| 2,879,534 | 3/1959 | Swanson et al. | 15/179 |
| 2,966,723 | 1/1961 | Swope | 29/120 |
| 3,280,516 | 10/1966 | Kimmerle . | |
| 3,451,433 | 6/1969 | Cunningham et al. | 242/118.32 X |
| 3,614,801 | 10/1971 | Peabody | 15/179 |

OTHER PUBLICATIONS

Flo-Pac 75 Cylinder Brushes Brochure, 1973.

*Primary Examiner*—Peter Feldman
*Attorney, Agent, or Firm*—Norman P. Friederichs

[57] ABSTRACT

A brush structure is provided including a laminated core of plastic sheet and fiber sheet. A laminated tube of plastic sheet and fiber sheet is also provided in the present invention.

21 Claims, 8 Drawing Figures

FIG. I
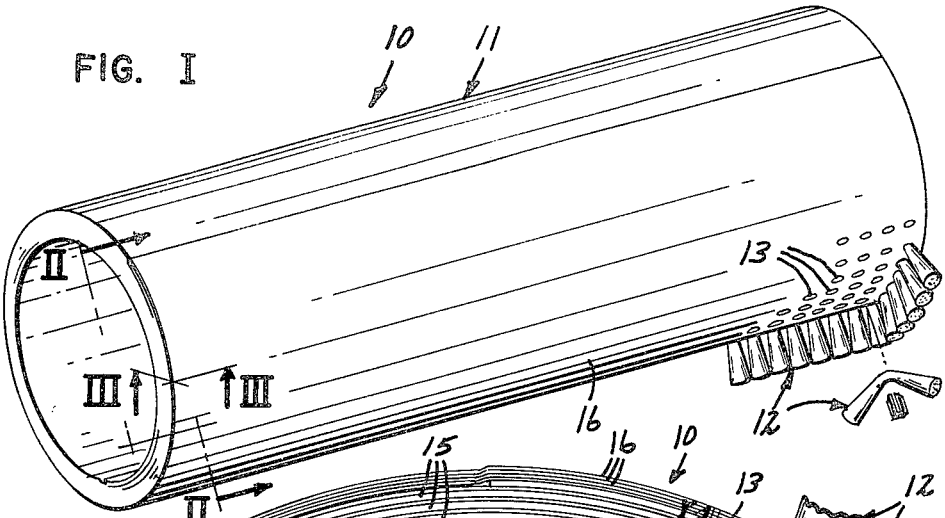
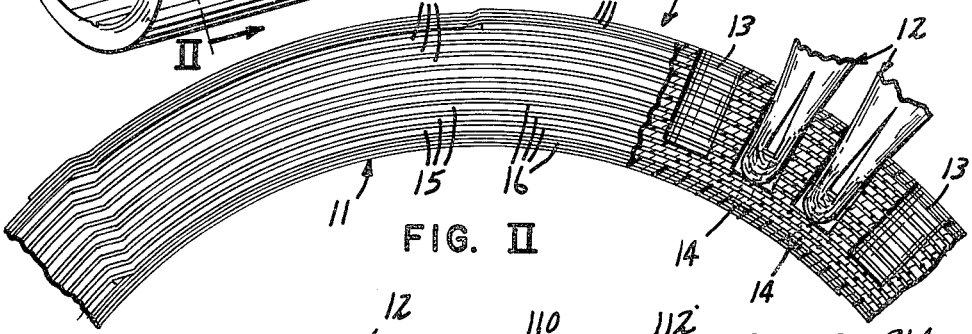
FIG. II
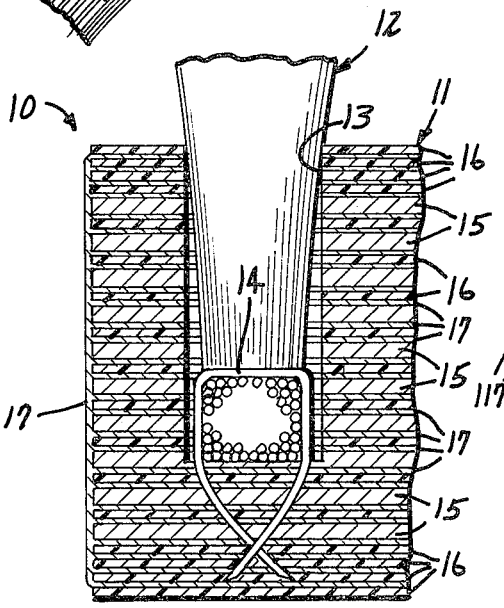
FIG. III
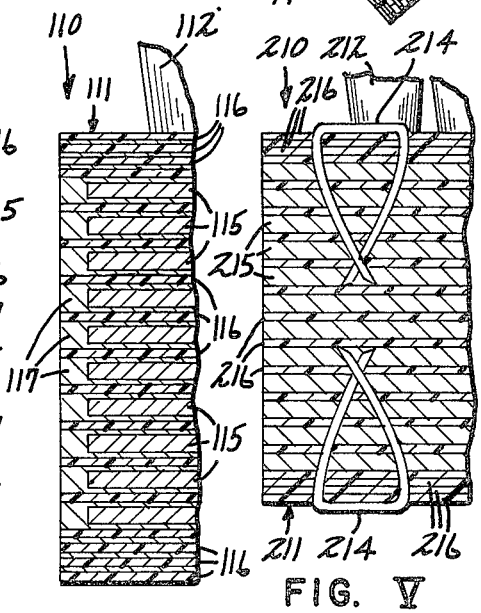
FIG. V
FIG. IV

FIG. VI
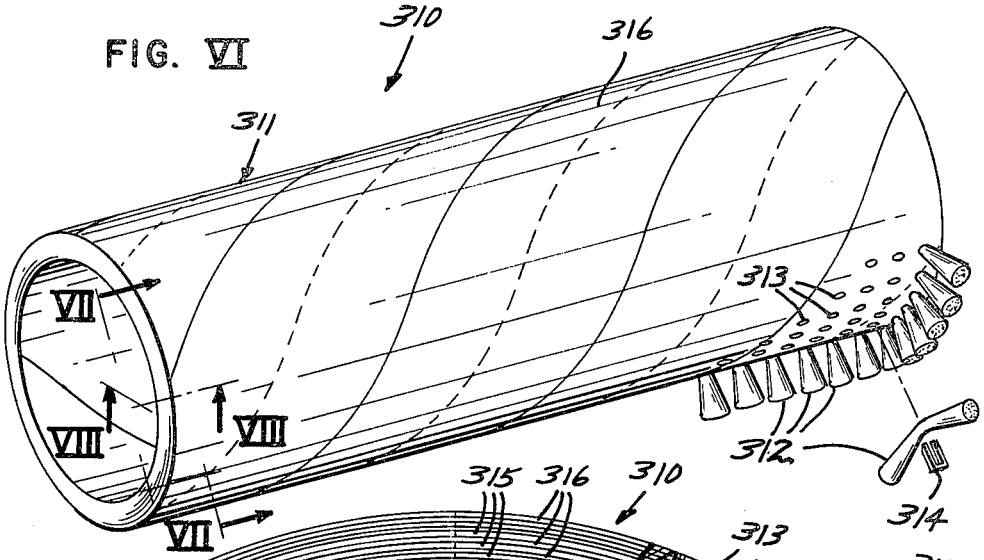
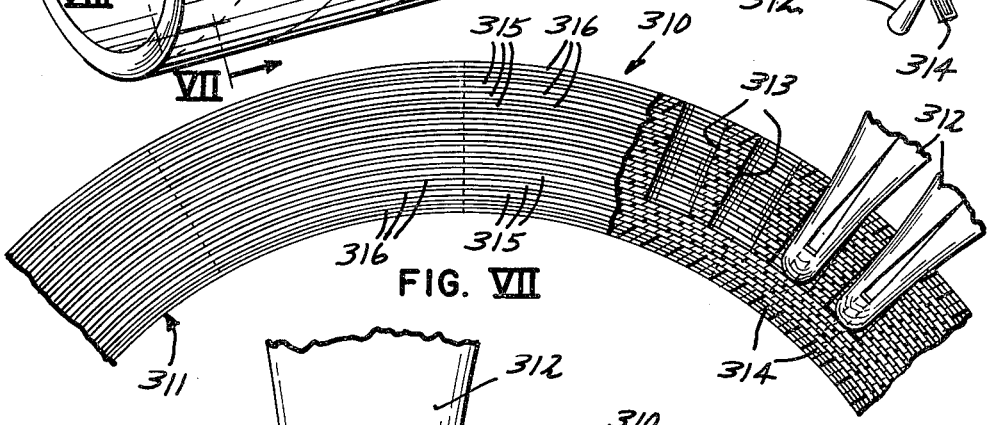
FIG. VII
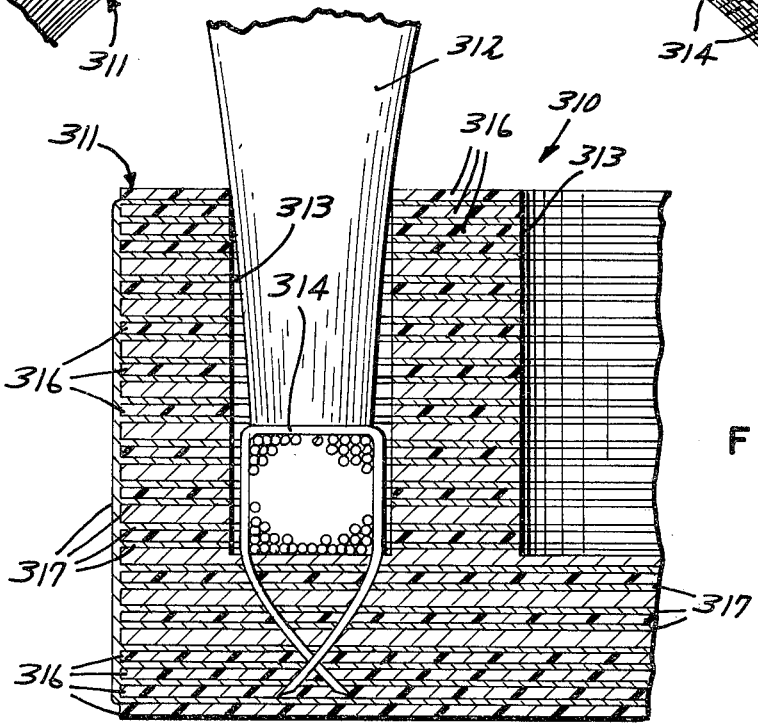
FIG. VIII

BRUSH STRUCTURE

FIELD OF THE INVENTION

The present invention relates to brush structures and more particularly to rotary brush structures for use on floor maintenance equipment. The brush structure includes a support member which carries a plurality of bristle bundles.

BACKGROUND OF THE INVENTION

Brush structures have long been used in a variety of environments including floor maintenance equipment. One type of brush structure is disclosed in U.S. Pat. No. 2,879,534. Such brush structure includes a plurality of plies of wound paper which is impregnated with a moisture-proofing and hardening agent. Tubes of this material have a plurality of tufts or bundles of fibers secured in cavities. This brush structure is perhaps the most commonly used and is relatively inexpensive in manufacture. It is well recognized that such paper-backed brushes have certain disadvantages. For example, paper-backed brushes are relatively dimensionally unstable. The lack of stability is particularly noticeable when the brush structure becomes damp; for example, when encountering surface water during sweeping or scrubbing. The water seeps into the paper and the paper begins to swell. Such paper-backed brushes are also susceptible to damage if the edge portions are struck by any hard objects. This may occur during shipment and handling of such brush structures; also, such damage may occur if the brush is removed from the floor maintenance equipment for any purpose such as repair of the equipment.

One highly stable brush structure includes a solid plastic backing member, for example of polypropylene, which has a plurality of bristle bundles or tufts mounted therein. This structure is strong, stable, and durable. However, it is very heavy and costly from a materials standpoint. Such a brush structure has the advantage that it is not susceptible to swelling due to impregnation by moisture.

An improved lightweight brush structure is shown in U.S. Pat. No. 3,614,801 issued to the Tennant Company. The latter provides a tubular brush including a backing member having a foamed plastic material as a core with an inner and an outer skin of more dense plastic material. This rotary tubular brush structure is lightweight and dimensionally stable. It has a high degree of durability and is not susceptible to damage by water. This rotary brush structure, however, is somewhat complicated in manufacture, which has a significant effect on the cost.

SUMMARY OF THE INVENTION

The present invention provides a brush structure having a laminated backing member with a plurality of cavities in which bundles of bristles are mounted. The backing member has alternating layers of fibersheet (i.e., paperboard or cardboard) and sheet plastic material. The alterating layers are adhered together, for example using an adhesive or a fusing of the plastic to the fibersheet. A cylindrical brush according to the invention may be formed as a straight or convolute wind of two or more sheets (e.g., a plastic sheet and a paper sheet) or formed as a spiral of two or more such sheets. The present invention may be manufactured with relative ease and is strong and durable. The present brush is less costly than a solid plastic cover to manufacture since the paper makes up much of the bulk. The present invention also reduces the amount of critical material (i.e., plastic) used in the brush structure. The present brush structure is dimensionally stable even in a moisture-laden environment and is relatively lightweight. In other words, the paper laminates make the brush lightweight and the plastic laminates prevent the brush from growing end-to-end or radially. The present brush structure may be used in environments where substantial water is encountered; for example, if desired, the same brush structure may be used with scrubbing machines as well as sweeping machines. The present brush structure may also be used in a variety of other environments and applications. Moreover, in its broader scope the present invention would contemplate use of the laminated tube for other purposes, e.g., shipping tubes, cores for paper winding, carpet cores, and the like.

BRIEF DESCRIPTION OF THE DRAWINGS

FIG. I is a perspective view of a tubular brush according to the present invention;

FIG. II is a cross-sectional view of a portion of the brush structure of FIG. I taken along the line II—II in FIG. I;

FIG. III is a cross-sectional view taken along the line III—III in FIG. I and shows a tuft secured in a cavity;

FIG. IV is a cross-sectional view similar to FIG. III but of a modified core structure;

FIG. V is a cross-sectional view similar to FIG. III but showing a further modification of the core structure;

FIG. VI is a perspective view of spiral wound tubular brush according to the present invention;

FIG. VII is a sectional view of the embodiment of FIG. VI taken along the line VII—VII in FIG. VI; and FIG. VIII is a sectional view of the brush of FIG. VI taken along the line VIII—VIII in FIG. VI.

DETAILED DESCRIPTION

The present brush structure 10 (FIGS. I–III) may include a backing member 11 which is commonly referred to as a "brush core." A plurality of tufts of bristles 12 are mounted in suitable cavities 13 in the core 11. The bristle tufts may be suitably held in place, for example by the staples 14. The backing member 11 is constructed of a plurality of alternating layers of paper or fiberboard 15 and sheet plastic 16.

The paper or fiberboard sheet 15 may be conventional paperboard or cardboard of the type commonly identified as 100% recycled newspaper and corrugated box materials. The thickness of the paperboard may be between 0.005 and 0.1 inch; however, other thicknesses may be used if desired. The overall thickness of adhered sheets may be 0.5 to 1.0 inches. The paperboard 15 may be treated by waterproofing or may be untreated. The sheet 15 may be of any fibrous material, even woven fabric.

Plastic sheet 16 may be of any plastic or resinous material desired. Typical suitable materials include polyethylene, polypropylene, polystyrene, and polyvinyl. The thickness of the plastic sheet 16 should be sufficient to provide the core 11 with dimensional stability and yet sufficiently thin to permit appropriate forming or shaping of the support as well as minimizing the overall weight of the brush structure. Typically, the thickness of the plastic layers will be 0.005 to 0.06 inch.

The cylindrical brush illustrated in FIGS. I–III may be formed of a single sheet of plastic 16 which is wound with a single sheet of paper or fiberboard 15 in a straight wrap. A suitable layer of adhesive 17 may be provided in between each wrap to secure the adjacent surfaces to each other. The adhesive 17 may be any water- or solvent-based adhesive. The adhesive 17 may alternatively be a conventional sheet adhesive which is heat-activated (e.g., ethylene vinyl acetate) or it may be an epoxy adhesive. In the case of heat-activated adhesive, wave energy may be used to activate the adhesive, for example, using microwave equipment. The adhesive, of course, should be of a type which will readily adhere to the plastic sheet material as well as to the paperboard. The core may be wound by hand on a mandrel or more preferably mechanically wound using conventional paper winding equipment.

Once the core is shaped or formed and the adjacent layers are secured, suitable cavities such as 13 may be cut into the core 11. Such cavities may be cut in any suitable manner; for example, utilizing the drilling techniques commonly used in the brush manufacturing industry. Next tufts of brush fibers 12 are secured in the cavities 13, such as by the staples 14. As illustrated in FIG. III, it is preferred that the inner and outer layers of the core 11 are of the plastic sheet material and desireably several of the innermost and outermost layers are of the plastic material.

ALTERNATE EMBODIMENTS

An alternate embodiment 110 of the invention is illustrated in FIG. IV. The alternate embodiment 110 may be constructed in a manner similar to that described in FIGS. I–III. The brush structure 110 is a laminated unit including alternating layers of paper or fiberboard 115 and plastic layers 116. The paper or fiberboard 115 may be of substantially the same composition as described with regard to paperboard layers 15 in brush 10. Likewise, the plastic layers 116 may be of the same type of composition as described with regard to layers 16 in brush structure 10. The brush structure 110 has the edge of the paper or fiberboard layers 115 inset from the edges of the plastic layers 116. Thus, in this embodiment, as the adhesive 117 fuses and flows it fills the short voids along the edge of the layers 115 and between adjacent sheets of plastic 116, thereby sealing the fiberboard 115 against any end impregnation by moisture or chemicals. In all other respects the brush structure 110 may be as described with regard to unit 10.

Brush structure 210, illustrated in FIG. V, may be constructed in a manner similar to brush unit 10; however, the layers are secured to one another in a manner different from that described with regard to units 10 and 110. Specifically, the brush structure 210 includes alternating layers of fiberboard 215 and plastic 216. The outer wraps in each case are of plastic sheet material and the laminated structure may be secured together by mechanical fastening devices; for example, staples 214 which extend through a plurality of the layers. In this instance, the brush unit 210 may be constructed without the use of adhesive. If desired, wave energy, e.g., ultrasonic welding, may be used to fuse the plastic layers 216 to the adjacent fiberboard layers 215.

FIGS. VI–VIII show a further embodiment of the present invention in which the brush 310 is formed from a plurality of spiral paper sheet strips 315 and plastic sheet strips 316 which are wrapped and glued with adhesive 317 to form a laminated tube 311 of paper and plastic. The edges of the strips are offset from the next inner and next outer strips as shown in FIG. VI. The plastic sheet strips 316 are applied in such a manner that at least the outer two layers and the inner two layers are plastic sheet, thereby further minimizing water impregnation. The plastic sheet 316 may be extruded simultaneously with the tube formation. In other words, the sheet may be extruded from a molten mass of plastic and the formed sheet passed directly to the tube-forming equipment. The tube-forming equipment may be the same equipment that is used to form conventional spiral pasteboard tubing.

Although specific embodiments of the present invention have been described, it is to be recognized that various modifications can be made without departing from the scope of the present invention. For example, the unit 10 is shown as a cylindrically shaped brush, such as for use on floor maintenance equipment. The brushes of the present invention may take various other forms. For example, such brushes may be in a disk-like shape or a frustoconical shape. Further, the backing member may be made from a prelaminated sheet of plastic-paperboard which is subsequently wound into a tube. The broader scope of the present invention contemplates forming tubes of laminated plastic and paperboard sheet for various end uses in addition to brush cores.

What is claimed is:

1. A cylindrical bristle brush for use on floor maintenance equipment, said brush including a laminated core of alternating wrapped layers of plastic and fiber sheet material, the innermost layer and the outermost layer both being plastic layers, said core including a plurality of plastic layers and a plurality of fiber layers, said plastic and fiber layers being adhered together, said core having a plurality of cavities and radially oriented bristles disposed in each of said cavities.

2. The brush of claim 1 wherein said plastic is a member selected from the group consisting of polyethylene, polypropylene, polystyrene, and polyvinyl.

3. The brush of claim 2 wherein said fiber sheet is paperboard.

4. The brush of claim 3 wherein said plastic and fiber layers are adhered together by an adhesive.

5. The brush of claim 4 wherein said adhesive is a heat sensitive adhesive.

6. The brush of claim 2 wherein said plastic and fiber layers are adhered together by ultrasonic welding.

7. A bristle brush comprising alternating layers of plastic and fiber sheet material, the language said brush including a plurality of plastic layers and a plurality of fiber layers, the innermost layer and the outermost layer both being plastic layers, said layers being secured together to provide a bristle support, a plurality of cavities in said bristle support, and a plurality of bristles held in each of said cavities.

8. The brush of claim 7 wherein said brush is a cylindrical brush and wherein said bristle support comprises a cylindrically shaped tube.

9. The brush of claim 8 wherein said plastic layers are comprised of a single sheet of plastic and wherein said fiber layers are comprised of a single sheet of fiberboard, said plastic sheet and said fiberboard sheet being wrapped a plurality of times to form said core.

10. The brush of claim 9 wherein said plastic is a member of the group consisting of polyethylene, polypropylene, polystyrene, and polyvinyl.

11. The brush of claim 10 wherein said fiberboard comprises paperboard.

12. The brush of claim 11 wherein said layers are secured together by mechanical fasteners.

13. The brush of claim 11 wherein said layers are secured together by adhesive.

14. The brush of claim 13 wherein said adhesive is a heat activated adhesive.

15. The brush of claim 11 wherein said layers are secured together by wave energy welding.

16. A cylindrical bristle brush for use on floor maintenance equipment, said brush comprising a laminated plastic and fiber core supporting a plurality of bristle bundles, said laminated core comprising a pair of wrapped sheets, said pair of wrapped sheets providing a plurality of layers of plastic sheet and a plurality of layers of fiber sheet, one of said sheets being a plastic sheet member selected from the group consisting of polyethylene, polypropylene, polystyrene, and polyvinyl, the other of said sheets being a member selected from the group consisting of paper and fabric, said core having at least an outermost layer comprised of plastic sheet.

17. The brush of claim 16 wherein said wrap is a straight wound wrap.

18. The brush of claim 16 wherein said wrap is a spirally wound wrap.

19. The brush of claim 16 wherein said core has at least two innermost wraps and at least two outermost wraps of plastic sheet.

20. The brush of claim 16 wherein said plastic sheet has a thickness in the range of 0.005 to 0.06 inch and said paper sheet has a thickness in the range of 0.005 to 0.1 inch.

21. The brush of claim 20 wherein the thickness of said laminated backing member is 0.5 to 1 inch in thickness.

* * * * *